US010219604B1

(12) United States Patent
Lee et al.

(10) Patent No.: US 10,219,604 B1
(45) Date of Patent: Mar. 5, 2019

(54) FACE PALETTE COSMETIC CASE

(71) Applicants: Janine Fung Hing Lee, Oakland, CA (US); Minhtran Thanh Nguyen, San Leandro, CA (US)

(72) Inventors: Janine Fung Hing Lee, Oakland, CA (US); Minhtran Thanh Nguyen, San Leandro, CA (US)

( * ) Notice: Subject to any disclaimer, the term of this patent is extended or adjusted under 35 U.S.C. 154(b) by 179 days.

(21) Appl. No.: 14/839,445

(22) Filed: Aug. 28, 2015

Related U.S. Application Data

(63) Continuation-in-part of application No. 29/482,092, filed on Feb. 13, 2014, now Pat. No. Des. 738,571.

(51) Int. Cl.
*A45D 33/20* (2006.01)
*A45D 40/24* (2006.01)
*A45D 33/00* (2006.01)

(52) U.S. Cl.
CPC ..... *A45D 40/24* (2013.01); *A45D 33/008* (2013.01); *A45D 33/20* (2013.01)

(58) Field of Classification Search
CPC ..... A45C 11/008; A45C 13/02; A45D 40/22; A45D 40/24; A45D 40/0087; A45D 2200/1036; A45D 33/20
See application file for complete search history.

(56) References Cited

U.S. PATENT DOCUMENTS

| | | | | |
|---|---|---|---|---|
| 2,205,974 A | | 6/1940 | Kramer | |
| D308,756 S | | 6/1990 | Turner | |
| 5,137,040 A | | 8/1992 | Iosilevich | |
| 5,579,940 A | * | 12/1996 | Weiss | A45C 11/008 132/287 |
| 6,631,806 B2 | | 10/2003 | Jackson | |
| 7,165,559 B1 | | 1/2007 | Goodman | |
| D620,638 S | | 7/2010 | Nelson | |
| 7,934,974 B2 | | 5/2011 | Kelly | |
| 8,597,667 B2 | * | 12/2013 | Mou | A45D 34/04 424/401 |
| D722,724 S | | 2/2015 | Guor | |
| 2002/0117423 A1 | | 8/2002 | Jackson | |
| 2004/0129588 A1 | | 7/2004 | Yi-Hung | |
| 2004/0200497 A1 | | 10/2004 | Thorpe | |
| 2004/0206370 A1 | | 10/2004 | Byun | |
| 2006/0188850 A1 | | 8/2006 | Mills | |

(Continued)

FOREIGN PATENT DOCUMENTS

| | | | | |
|---|---|---|---|---|
| FR | 2695015 A1 | * | 3/1994 | A45D 40/22 |
| WO | WO2007058591 | | 5/2007 | |
| WO | WO 2014003183 A1 | * | 1/2014 | A61Q 19/00 |

OTHER PUBLICATIONS https://web.archive.org/web/20130720004629/https://www.wikihow.com/Contour-Your-Nose. How to contour your nose. WikiHow. Jul. 30, 2013.*

*Primary Examiner* — Rachel R Steitz
(74) *Attorney, Agent, or Firm* — Law Office Of Rodney LeRoy

(57) ABSTRACT

A cosmetic case is provided that includes a top case hinge attached to a bottom case. A cosmetic tray is positioned in the bottom case. The cosmetic tray includes a plurality of cosmetic recesses forming a face palette of recesses. The cosmetic recesses contain cosmetics that form a face palette of cosmetics. Shapes and sizes of the cosmetic recesses indicate an application shape and an application extent of the cosmetics on a user's face to achieve an aesthetic cosmetic appearance.

36 Claims, 6 Drawing Sheets

(56) References Cited

U.S. PATENT DOCUMENTS

| | | | | |
|---|---|---|---|---|
| 2008/0053476 | A1* | 3/2008 | LaHood | A45D 33/38<br>132/320 |
| 2009/0120565 | A1* | 5/2009 | Marshall | B44C 1/105<br>156/230 |
| 2010/0319723 | A1* | 12/2010 | Parker | A45D 33/20<br>132/287 |
| 2014/0224275 | A1 | 8/2014 | Peterson | |

* cited by examiner

FACE PALETTE COSMETIC CASE

CROSS-REFERENCE TO RELATED APPLICATIONS

This patent application is a continuation-in-part application of U.S. design patent application 29/482,092, filed Feb. 13, 2014, which is incorporated by reference in its entirety along with all other references cited in these applications.

BACKGROUND OF THE INVENTION

The present invention generally relates to cosmetics. More particularly, implementations of the present invention provides a cosmetic case having a face palette of cosmetics for guiding a user for applying the cosmetics to the user's face.

The use of cosmetics in cultures across the globe reaches back several millennia and spans to modern time. People in ancient cultures across all continents and island cultures used cosmetics in rituals and eventually for beauty enhancement. Ancient cultures of Asia used cosmetics on their fingernails, hands, and faces to beautify and for class distinctions. Ancient Egyptian and Greek cultures similarly used cosmetics, such as bees wax and oils as skin emollients and kohl to accentuate eye shape to make eyes appear conspicuously almond shaped.

In some ancient cultures, cosmetic use rose to high art. In southern Asia and Northern Africa, for example, the use of henna and turmeric was, and continues to be, used by women to create artistically-elaborate skin decorations. Mehndi skin art, for example, is often applied for festive occasions, such as weddings, religious events, and traditional ceremonies, and often includes intricate, artistic images of the sun or other designs placed on hands or feet. Such Mehndi images and designs are often placed on the skin as symbols of good luck, health, or sensuality.

As the use of cosmetics has evolved to modern time, the applications and the effects achieved by the applications have become relatively complex. For example, one or multiple layers of cosmetics are often applied to create a neutral foundation palette on the face for further cosmetic application. A single cosmetic, such as a liquid foundation, a cream foundation, or a power foundation, can be applied alone to create a neutral pallet, or these cosmetics can be used in combination to achieve various effects.

Over a foundation layer or bare skin, cosmetics can be applied to the face in multiple layers, adjacent layers, blended layers, or combination of these layers to create a variety of effects, such as contouring, highlighting, or both to accentuate or de-emphasize facial features, face shape, or both. For example, a relatively broad facial feature, such as a broad jaw or nose can be made to appear more aquiline using a highlighting cosmetic, a contouring cosmetic, or both. Alternatively, aquiline features, such as an aquiline jaw or nose, can be made to appear broader using highlighting cosmetics, contouring cosmetics, or both. Similarly, cheekbones, a chin, jaw lines, a forehead, or a combination of these facial elements can also be accentuated or de-emphasized by contouring, highlighting, or both.

Implementations of the present invention provide a guiding palette for cosmetic applications to achieve contouring, highlighting, or other effects.

BRIEF SUMMARY OF THE INVENTION

Implementations of the present invention generally relate to a cosmetic tray having an arrangement of cosmetics that provides a cosmetic guide for a user for applying the cosmetics to the user's face in a manner that corresponds to the arrangement of the cosmetics in the tray. More particularly, implementations of the present invention provide a cosmetic tray having a palette of recesses, such as a face palette of recesses, for holding a palette of cosmetics, such as a face palette of cosmetics, where the palette of recesses and the palette of cosmetics in the recesses resembles a face or portions of a face that guide a user to apply the cosmetics to the user's face in a manner that corresponds to the positions of the recesses and the cosmetics in the recesses to achieve an aesthetic appearance of cosmetics on the user's face. The cosmetic guide allows a user to achieve aesthetic cosmetic appearances that may be relatively complex, such as contouring and highlighting, various eyelid patterns, various lip patterns, or other appearances.

In an implementation, the cosmetic tray includes a first plurality of cosmetic recesses, forming a forehead palette. The first plurality of cosmetic recesses includes right and left forehead recesses, right and left eyebrow recesses positioned respectively below the right and left forehead recesses, and a center recess positioned between the right and left eyebrow recesses. The cosmetic tray includes a right eyelid recess, positioned below the right eyebrow recess. The cosmetic tray includes a left eyelid recess, positioned laterally adjacent to the right eyelid recess and below the left eyebrow recess.

The cosmetic tray includes a second plurality of cosmetic recesses, forming a nose palette. The second plurality of cosmetic recesses includes a right side nose recess, a left side nose recess, and a nose bridge recess positioned between the right and left side nose recesses.

The cosmetic tray includes a third plurality of cosmetic recesses, forming a right cheek palette. The third plurality of cosmetic recesses includes a first cheek recess and a second cheek recess where the first cheek recess is positioned above the second cheek recess and below the right eyelid recess;

The cosmetic tray includes a fourth plurality of cosmetic recesses, forming a left cheek palette. The fourth plurality of cosmetic recesses includes a third cheek recess and a fourth cheek recess where the third cheek recess is positioned above the fourth cheek recess and below the left eyelid recess. The cosmetic tray includes a lip recess, forming a lip palette, where the lip recess is positioned below the nose palette.

In a specific implementation, the nose bridge recess has an elongated shape that is approximately triangular. The right nose recess has a first arc shape, the left nose recess has a second arc shape, and the first and second arc shapes are laterally opposite arc shapes. Specifically, the first and second arc shapes have openings that face away from each other.

In another specific implementation, the lip recess includes an upper lip portion having an upper lip shape and a lower lip portion having a lower lip shape wherein the upper and lower lip shapes approximately match human lip shapes with a cupid's bow, a rounded bottom lip line, and acute corners that form right and left extents of the lip recess.

The lip recess can has a partition positioned between and separating the upper lip recess from the lower lip recess where these two recesses can have the same cosmetic or different cosmetics positioned in these recesses.

In another specific implementation, the right eyelid recess has a first arc shape, the second eyelid recess has a second arc shape, and the first and second arc shapes are laterally opposite shapes.

In another specific implementation, the cosmetic tray includes a nose line positioned on the tray, formed in the cosmetic tray, or both. The nose line is below the nose palette and above the lip palette and has first and second line portions that are right and left nostril lines and has a third line portion that is a septum line positioned between the right and left nostril lines.

In another specific implementation, the first, second, third, and fourth plurality of recesses, the right and left eyelid recesses, and the lip recess form a facial image for a face palette of cosmetics where a cosmetic palette of cosmetic can be positioned in the recesses forming the facial palette. In another specific implementation, the cosmetic tray includes one or more cosmetic recesses not forming a portion of the face palette.

In another specific implementation, the cosmetic tray includes a line positioned on the tray, formed in the tray, or both that represents a jaw line for facial image of the face palette.

In another specific implementation, the cosmetic tray includes one or more applicator recesses adapted for holding one or more cosmetic applicators.

In another specific implementation, the cosmetic tray includes a plurality of cosmetics located in the first, second, third, and fourth plurality of recesses, the right and left eyelid recesses, and the lip recess that form a face palette of cosmetics for the face palette formed by the recesses.

In one implementation, the cosmetic case includes a top case, a bottom case coupled to the top case, and a first cosmetic tray positioned in the bottom case. The first cosmetic tray includes a first plurality of recesses forming a first face palette of recesses and adapted to contain a first plurality of cosmetics that form a first face palette of cosmetics when the first plurality of cosmetics is positioned in the first plurality of recesses.

In a specific implementation, the cosmetic tray includes a cosmetic recess not forming a portion of the face palette of recesses where a cosmetic not forming a portion of the face palette of cosmetics can be positioned.

In another specific implementation, the cosmetic tray includes a first drawer extendabley inserted in a slot of the bottom case, and includes a second cosmetic tray positioned in the first drawer. The second cosmetic tray comprises a second plurality of recesses forming a second face palette of recesses and adapted to contain a second plurality of cosmetics that form a second face palette of cosmetics when the cosmetics are positioned in the second plurality of recesses. Alternatively, the second cosmetic tray can include one or more recesses not forming a facial palette of recesses.

In another specific implementation, the cosmetic tray includes a second drawer extendabley inserted in a second drawer slot of the bottom case, and includes a third cosmetic tray positioned in the second drawer. The third cosmetic tray comprises a plurality of recesses adapted for containing a plurality of cosmetic applicators. Alternatively, the third cosmetic tray can include a third plurality of recesses forming a third face palette of recesses adapted to contain a third plurality of cosmetics that form a third face palette of cosmetics when the cosmetics are positioned in the third plurality of recesses.

In another specific implementation, the first cosmetic tray comprises a first plurality of cosmetic recesses, forming a forehead palette, comprising right and left forehead recesses, right and left eyebrow recesses positioned respectively below the right and left forehead recesses, and a center recess positioned between the right and left eyebrow recesses; a right eyelid recess, positioned below the right eyebrow recess; a left eyelid recess, positioned laterally adjacent to the right eyelid recess and below the left eyebrow recess; a second plurality of cosmetic recesses, forming a nose palette, comprising a right side nose recess, a left side nose recess, and a nose bridge recess positioned between the right and left side nose recesses; a third plurality of cosmetic recesses, forming a right cheek palette, comprising a first cheek recess and a second cheek recess, wherein the first cheek recess is positioned above the second cheek recess and below the right eyelid recess; a fourth plurality of cosmetic recesses, forming a left cheek palette, comprising a third cheek recess and a fourth cheek recess, wherein the third cheek recess is positioned above the fourth cheek recess and below the left eyelid recess; and a lip recess, forming a lip palette, positioned below the nose palette.

In one implementation, a method includes providing a cosmetic tray; forming a first plurality of cosmetic recesses in the cosmetic tray for a forehead palette, wherein the first plurality of cosmetic recesses comprises right and left forehead recesses, right and left eyebrow recesses positioned respectively below the right and left forehead recesses, and a center recess positioned between the right and left eyebrow recesses; forming a right eyelid recess in the cosmetic tray, wherein the right eyelid recess is positioned below the right eyebrow recess; forming a left eyelid recess in the cosmetic tray, wherein the left eyelid recess is positioned laterally adjacent to the right eyelid recess and below the left eyebrow recess; forming a second plurality of cosmetic recesses in the cosmetic tray for a nose palette, wherein the second plurality of cosmetic recesses comprises a right side nose recess, a left side nose recess, and a nose bridge recess positioned between the right and left side nose recesses; forming a third plurality of cosmetic recesses in the cosmetic tray for a right cheek palette, wherein the third plurality of cosmetic recesses comprises a first cheek recess and a second cheek recess, and the first cheek recess is positioned above the second cheek recess and below the right eyelid recess; forming a fourth plurality of cosmetic recesses in the cosmetic tray for a left cheek palette, wherein the fourth plurality of cosmetic recesses comprises a third cheek recess and a fourth cheek recess, and the third cheek recess is positioned above the fourth cheek recess and below the left eyelid recess; and forming a lip recess for a lip palette, wherein the lip recesses is positioned below the nose palette.

In a specific implementation, each of the recesses has a shape that indicates an extent for applying a cosmetic in the recess to a user's face.

In another specific implementation, the method includes forming a first line in the cosmetic tray below the nose palette and above the lip palette, wherein the first line has right and left nostril lines and a septum line positioned between the right and left nostril lines, and forming a second line in the cosmetic tray representing a jaw line for a face palette formed by the recesses.

In another specific implementation, the first, second, third, and fourth plurality of recesses, the right and left eyelid recesses, and the lip recess form a facial image for a face palette of cosmetics.

In another specific implementation, the method includes forming an additional cosmetic recess in the cosmetic tray where the additional cosmetic recess does not form a portion of the face palette of recesses.

In another specific implementation, the method includes inserting a plurality of cosmetics into one or more of the recesses.

Other objects, features, and advantages of the present invention will become apparent upon consideration of the following detailed description and the accompanying drawings, in which like reference designations represent like features throughout the figures.

DETAILED DESCRIPTION

The present invention generally provides a cosmetic tray having an arrangement of cosmetics that provides a cosmetic guide for a user for applying the cosmetics to the user's face in a manner that corresponds to the arrangement of the cosmetics in the tray. More particularly, implementations of the present invention provide a cosmetic tray having a palette of recesses, such as a face palette of recesses, for holding a palette of cosmetics, such as a face palette of cosmetics, where the palette of recesses and the palette of cosmetics in the recesses resembles a face or portions of a face that guide a user to apply the cosmetics to the user's face in a manner that corresponds to the positions of the recesses and the cosmetics in the recesses to achieve an aesthetic appearance of cosmetics on the user's face. The cosmetic guide provided by the face palette allows a user to achieve aesthetic cosmetic appearances that may be relatively complex, such as cosmetic contouring, cosmetic highlighting, blending cosmetic contouring and cosmetic highlighting, various cosmetic eyelid patterns, various cosmetic lip patterns, a single one of these appearances, a combination of one or more of these appearances in any combination, or other appearances.

Figure 1:
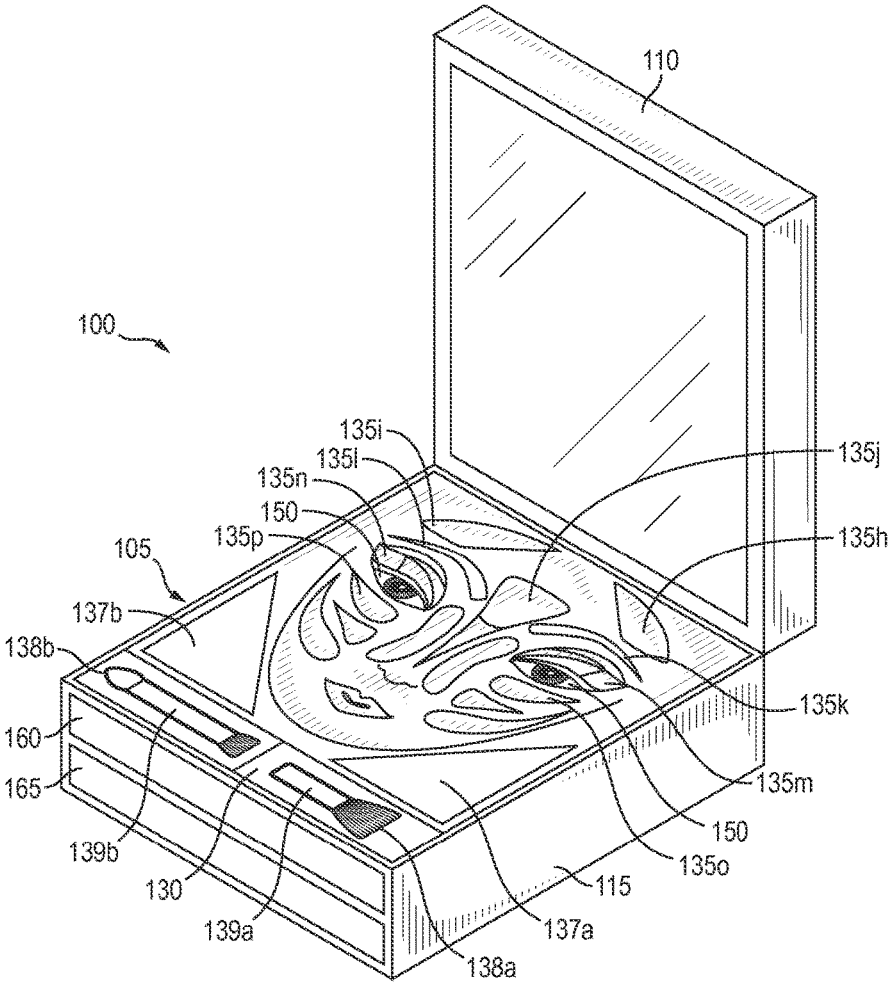
FIG. 1 is a perspective view of a cosmetic case having a face palette of cosmetics.

FIG. 1 is an overall perspective view of a cosmetic case 100 according to one implementation of the present invention. The cosmetic case is sometimes referred to in this patent as a cosmetic compact or a compact. The cosmetic case includes a cosmetic palette 105 of cosmetics. In an implementation, the cosmetic palette is a face palette of cosmetics or includes a face palette of cosmetics. In other implementations, the cosmetic palette is face portion palette, such as an eye palette of cosmetics, a cheek palette of cosmetics, a nose palette of cosmetics, a forehead palette of cosmetics, an eyebrow palette of cosmetics, a lip palette of cosmetics, or other face portion palette of cosmetics. The cosmetic palette includes a number of cosmetics positioned in the cosmetic palette where the positions, shapes, or both of the cosmetics in the cosmetic palette correspond to facial locations where the cosmetics are to be applied to achieve a cosmetic effect that the cosmetic palette is arranged to achieve.

In some implementations, the cosmetic palette includes cosmetics that guide a user to achieve one or more of a variety of cosmetic effects on one or more portions of the user's face. These cosmetic effects include, for example, highlighting, contouring, highlighting and contouring, blending, various eye and eyelid effects, eyebrow effects, lip effects, cheek and cheekbone effects, and other cosmetic effects.

Highlighting cosmetics and contouring cosmetics can be used alone or in combination to achieve a variety of effects. For example, the use of highlighting cosmetics, contouring cosmetics, or both can make the face, select facial features, or both appear more prominent, less prominent, or appear to change shape. The use of one or both of these cosmetics can make the face, a facial portion, or both appear broader, slimmer, shorter, longer, heart shaped, diamond shaped, less oblong, more oblong, more squatted off, less squared off, increase roundness, decrease roundness, or facilitate other shape change appearances.

Cosmetic highlighting includes lightening the appearance of a portion of the face or other body part by the application of a highlighting cosmetic that is lighter than a skin tone of skin that the highlighting cosmetic is applied to, is lighter than a foundation layer, or is lighter than another cosmetic, such as a contouring cosmetic. Highlighting cosmetics are typically tinted giving the highlighting cosmetic a relatively light appearance. Highlighting cosmetics tend to be relatively light browns, tans, and beiges. Further, these cosmetics can be relatively color neutral, or have added hues, such as pinks, orange, yellows, greens, gold, silver, bronze, or other colors. Highlighting cosmetics can include highlighting creams, highlighting liquids, and highlighting powers.

Cosmetic highlighting can make the highlighted portion of the face prominent in appearance. For example, a highlighting cosmetic applied to a jawline, can make the jawline appear wider. A person may use a highlighting cosmetic on a jawline, if the person has a relatively narrow jawline and desires to create the appearance of a wider jawline. Highlighting the bridge of the nose to make the bridge of the nose more prominent in appearance to provide a sliming appearance of the nose. Alternatively, the sides of the nose may be highlighted to make the nose appear broader. Highlighting cosmetics can be applied to the outer sides of the eye sockets, under the eyes, between the eyes, or a combination of these applications to make a person's eyes appear larger. Highlighting cosmetic can be applied to the tip of the chin to make a chin more prominent, which can also make a person's face appear slimmer.

Cosmetic contouring includes darkening the appearance of a portion of the face or other body part by the application of a contouring cosmetic that is darker than a skin tone of skin that the highlighting cosmetic is applied to is darker than a foundation layer, or is darker than another cosmetic, such as a highlighting cosmetic. Similar to highlighting cosmetics, contouring cosmetics can be relatively color neutral, or have added hues, such as pinks, orange, yellows, greens, gold, silver, or other colors. Contouring cosmetics can be shaded to provide a relatively darkened hue and may or may not be tinted.

Contouring can make the contoured portion of the face less prominent in appearance. For example, a contouring cosmetic applied to a cheek, can make the cheek less pronounced, which can make the cheekbone ridge above the cheek, the jawline below the cheek, or both appear more pronounced. A highlighting cosmetic applied at the cheekbone ridge above the contouring cosmetic on the cheek, can further enhance the cheekbone ridge making the cheekbone ridge appear relatively more prominent. A highlighting cosmetic applied to the jawline below or in front of the contouring cosmetic on the cheek, can further enhance the jawline making the cheekbone appear relatively more prominent. In addition, highlighting cosmetic applied on the chin adjacent to the contouring cosmetic on the cheek, can similarly further enhance the appearance of the chin making the chin appear more pronounced.

Contouring cosmetics applied to the side of the nose can decrease the prominence of the sides of the nose, which makes the nose's bridge more prominent providing a slimming appearance to the nose. Highlighting cosmetics applied to the bridge of the nose, with contouring cosmetics applied to the sides of the nose, can further enhance this slimming appearance.

Implementation of the cosmetic case of the instant invention provides a guide and the cosmetics for achieving the above described highlighting and contouring. These features and benefits of the present invention are described further below with respect to example implementations.

In one implementation, cosmetic case 100 includes a top case portion 110 (sometimes referred to in this patent as a top, a top case, or a lid) and a bottom case portion 115 (sometimes referred to in this patent as a bottom, a bottom case, or a base). The top case portion forms a lid for the bottom case portion. The top and bottom case portions can be formed from a variety of materials, such as plastic, metal, or other substances.

Figure 5:
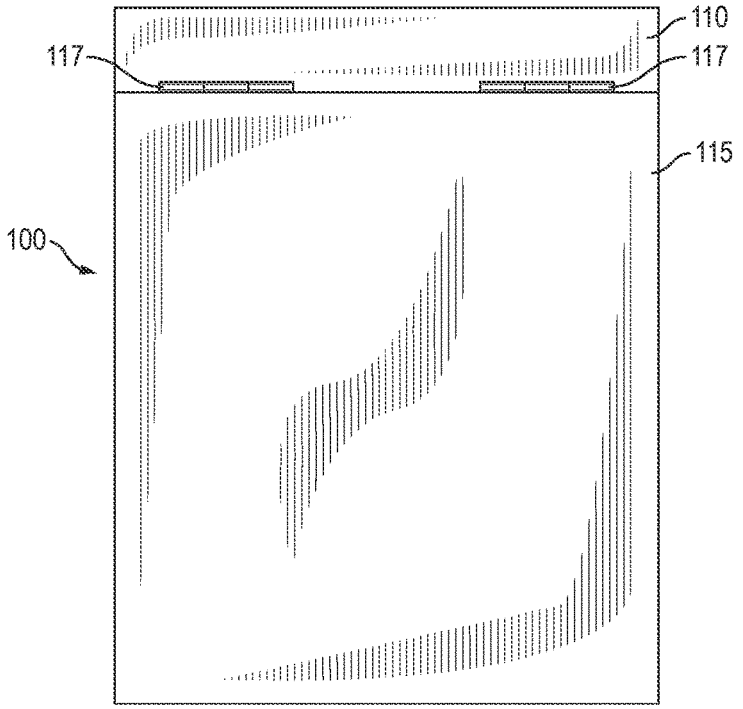
FIG. 5 is a bottom view of the cosmetic case with the top in the open position.
Figure 9:
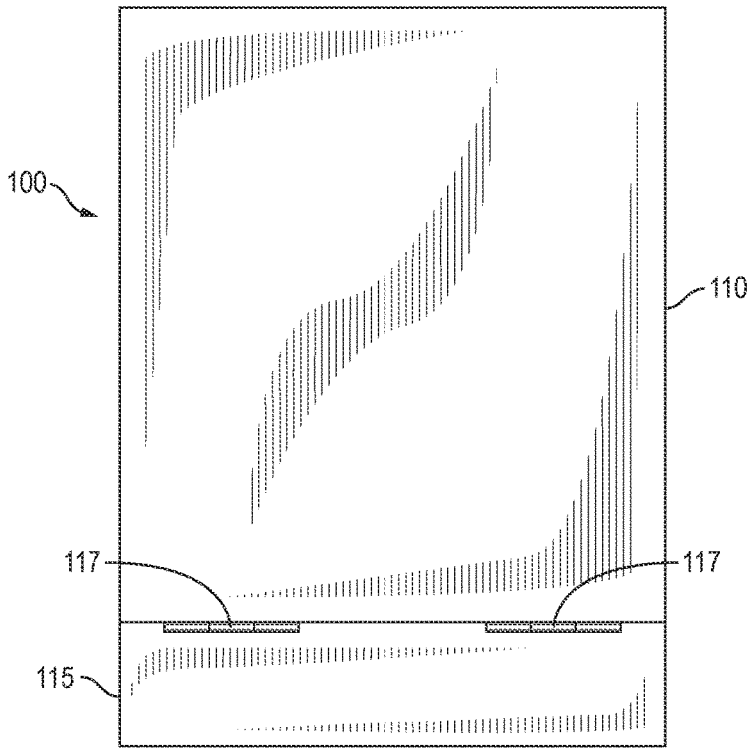
FIG. 9 is a back view of the cosmetic case with the top in the open position.

The top case portion may be attached to the bottom case portion via a variety of devices and attachment methods, such as one or more hinges 117 shown in FIGS. 5 and 9 (back and bottom views, respectively), slide attached (from the top, back, front, or side of the bottom case portion), snap attached, or otherwise attached to the bottom case portion.

In an implementation where the top and bottom case portions are hinge attached, the hinge applies a spring force to hold the top and bottom case portions in a closed positioned when closed, and may hold the top and bottom case portions in an open position when these portions are opened.

In an implementation where the top case portion is slide attached to the bottom case portion, the top and bottom case portions are separable. In a closed position, the top case portion covers cosmetic palette 105, and in an open positioned or removed position, the cosmetic palette is exposed for use.

The top case portion, the bottom case portion, or both can include one or more latches to latch to top case portion to the bottom case portion when these portions are in a closed configuration. The latch can be integrally formed with one or both of the case portions on an inside or outside of the case portions. Alternatively, the latch or portions of the latch can be mechanically connected to the top case portion, bottom case portion, or both. The latch can include one or more spring loaded portions to spring load the latch for maintaining the cosmetic case in a closed a configuration.

An underside of the top case portion includes a mirror 120 in one implementation. With the top and bottom case portions in the open position, the mirror is positioned adjacent to and above the cosmetic palette for ease of viewing while applying the cosmetics positioned in the cosmetic palette. The mirror may be substantially coextensive with the top case portion, or may be framed by a frame portion 125 of the top case portion. The mirror may be a flat mirror or a magnifying mirror, such as a magnifying mirror having a two times magnification, a two and a half times magnification, a three times magnification, a three and a half times magnification, a four times magnification, a four and a half times magnification, a five times magnification, or higher magnification.

The cosmetic case includes at least one cosmetic tray 130 that is positioned in the bottom case portion where the cosmetic tray includes a face palette of recesses (or a face palette). Cosmetic tray 130 may be integrally formed with the bottom case portion or may be removable from the bottom case portion where a different or the same tray can placed back into the bottom case, such as with different cosmetics in the replacement tray.

The cosmetic tray includes a number of recesses 135*a*-135*s* (generally recesses 135) formed in the tray that compose the face palette. While cosmetic tray 130 is shown in FIG. 1 as including twenty-one recesses, the cosmetic tray may include more or fewer recesses. Each of recesses 135*a*-135*q* are positioned in the tray at locations in the face palette that corresponds to facial locations of facial features of a human face.

For example, in one implementation, recesses 135*a* and 135*b* are positioned on a right side of the face palette and are a right cheek palette, and recesses 135*c* and 135*d* are positioned on a left side of the face palette and are a left cheek palette. The right and left cheek palettes are positioned in cheek locations on the face palette and correspond to the facial location of cheeks of a human face.

Specifically, recess 135*a* is a right cheekbone ridge recess and recess 135*b* is a right cheek recess. The right cheekbone ridge recess is located above the right cheek recess in the face palette. Right cheekbone ridge recess 135*a* corresponds to the facial location of a right cheekbone ridge. Right cheek recess 135*b* corresponds to the facial location of a right cheek. Recess 135*c* is a left cheekbone ridge recess and recess 135*d* is a left cheek recess. The left cheekbone ridge recess is located above the left cheek recess in the face palette. Left cheekbone ridge recess 135*c* corresponds to the facial location of a left cheekbone ridge. Left cheek recess 135*d* corresponds to the facial location of a left cheek.

In one implementation, the right cheekbone ridge recess and the right cheek recess include cosmetics that can be blended. The tray includes one or more indicators to indicate that the cosmetics in these recesses can be blended. For example, the right cheekbone ridge recess and the right cheek recess can be joined at a side portions of these recesses that indicates the that cosmetics can be blended. The tray can include other indicators that the cosmetics in these recesses can be blended, such as arrows (for example, double sided arrows positioned on the tray between the recesses), or text (for example, "blend"). The left cheekbone ridge recess and the left cheek recess can similarly include cosmetics that can be blended. The tray includes one or more of the indicators described above for indicating the possibility of blending the cosmetics from these recesses.

In one implementation, the cheekbone ridge recesses and the cheek recesses have shapes that correspond to portions of the cheekbone ridges and the cheeks of a user's face where the cosmetics in these recesses are to be applied. For example, the right and left cheekbone ridge recesses are shown as substantially triangular with blunt portions of the triangles facing the nose portion of the face palette and tapered portions of the triangle extending right and left in the face palette toward the back of the cheeks and toward the sides of the face palette. The substantially triangular shapes indicate to a user that the cosmetics in the cheekbone ridge recesses should be applied in corresponding substantially triangular regions of the cheekbones.

The right and left cheek recesses are shown as substantially teardrop shaped with rounded portions of the teardrops facing toward the upper lip and nose and tapered portions of the teardrops rising upward in the face palette. The teardrop shapes indicate to a user that the cosmetics in the cheek recesses should be applied in corresponding substantially teardrop shape regions of the cheeks at a raising angle along the cheeks.

While the cheekbone ridge recesses and the cheek recesses are described and shown as substantially triangular and teardrop in shape, these recesses may have other shapes, such as oblong, round, rectangular or other shapes. Further, while the right and left cheek palettes are described and shown as including two recesses each, the right and left cheek palettes may include one recess or may include more than two recesses. For example, each of the check palettes may include three cosmetic recesses including a cheekbone ridge recess, a cheek recess, and a jawline recess (not shown) along the jaw line below the cheek recesses. The cosmetics in right and left jawline recesses in the right and left cheek palettes can include highlighting cosmetics or contouring cosmetics.

In one implementation, recesses 135*e*, 135*f*, and 135*g* are a nose palette. Recess 135*e* is a right side nose recess and is positioned on the right side of the nose pallet, recess 135*f* is a left side nose recess and is positioned on the left side of the nose pallet, and recess 135*g* is a nose bridge recess and is positioned on a nose bridge portion in the nose palette. The nose bridge recess is positioned at least in part between the right and left side nose recesses.

The nose palette may include various lines positioned on cosmetic tray 130 to make the nose palette appear esthetically pleasing and appear similar to facial features of a human face. For example, the nose palette includes a nose line 140, which can be a continuous line or a broken line, at the bottom of the nose palette to indicate nostrils and a septum. The line can be a painted line on a top surface of the tray or on a bottom surface of the tray if the tray is clear or translucent. The line can be a trench formed in the tray in the top surface of the tray or the bottom surface of the tray if the tray is clear or translucent. The line can be a ridge formed on the tray, such as on the top surface of the tray or the bottom surface of the tray if the tray is clear or translucent. The line can be painted in the trench or ridge for further enhancement of the appearance of the nose line. The line can also be formed in other ways. The face palette may include additional lines that are continuous or broken on the tray or formed in the tray that provide additional facial features to give the face palette a face like and esthetically pleasing appearance, such as a jaw and chin line 145, ear lines (not shown), a forehead line, or other lines.

The right and left nose recesses include a contour cosmetic and the nose bridge includes a highlight cosmetic, for example, if a sliming appearance is to be achieved with the nose palette. Alternatively, the right and left recesses include a highlight cosmetic and the nose bridge includes a contour cosmetic, for example, if a different appearance is to be achieved with the nose palette, such as a broadening appearance.

Right and left nose recesses 135*e* and 135*f* are elongated along the sides of the nose palette and have approximately crescent shapes. These recesses may have other shapes, such as complex shapes that extend along the sides of the nose palette along nostril portions of the nose palette.

The nose bridge recess is substantially triangular shaped, for example acute triangular shaped, with a broad end of the triangle positioned upward on the face palette between the eye portions or the eyelid portions of the face palette, and the triangle tapering downward along the nose bridge portion of the nose palette. The nose bridge recess may have other shapes, such as rectangular, oval, or other shapes.

While the nose palette is shown with three recesses, this palette may include fewer or more recesses. For example, the nose palette may include a recess at approximately the septum of the nose in the nose palette where a contouring cosmetic may be placed, for example, for making a nose appear shorter, or where a highlighting cosmetic may be placed, for example, for making a short nose appear longer.

In one implementation, the face palette includes a forehead palette that includes a number of recesses for cosmetics. In one implementation, the forehead palette includes right and left forehead recesses 135*h* and 135*i*, a center recess 135*j*, and right and left eyebrow recesses 135*k* and 135*l*. The forehead palette can include fewer or more recesses.

The right and left forehead recesses are located at upper right and left portions of the face palette above the eyebrow palettes. The forehead recesses are approximately sector shaped (i.e., a sector portion of a circle, a sector portion of an oval, a sector portion of an ellipse, or a sector of other oblong shapes) but can have over shapes in alternative implementations, such as arc shaped, round, oblong, rectangular, or other shapes. In one implementation, the right and left forehead recesses are joined to form a single recess, that can be arced, have a sector shape or other shape. The forehead recesses can have highlighting or contouring cosmetics positioned in the recesses for various cosmetic effects, such as reducing the apparent height of a forehead, increasing the apparent height of a forehead, decreasing the apparent width of a forehead, increasing the apparent width of a forehead, or allowing for other apparent shape changes, such squaring, rounding, or other shape changes.

Center recess 135*j* is positioned above the nose bride recess 135*g* and between the right and left eyebrow recesses. The center recess has an approximately triangular shape with a truncated bottom portion, where a wide end of the truncated triangle is directed upward, and the truncated bottom portion of the triangle is directed downward. The vertices of the truncated triangle are rounded and one or more sides are rounded, such as the bottom-truncated side that meets the nose bridge recess. In one implementation, the center recess and the nose bridge recess do not meet. In other implementations, the center recess can have other shapes, such as fan shaped, triangular, or other shapes. The center recess can be filled with a highlighting cosmetic to highlight the space between a user's eyes and create the appearance of lowering the forehead to create an oval appearance of the face. Alternatively, the center recess can be filed with a contour cosmetic for application to a user's face for creating affects, such as creating the appearance of a lower forehead.

The right and left eyebrow recesses 135*k* and 135*l* are arc shaped and can be shaped as arched triangles (e.g., one or more of the three sides can be curved) or other shapes to approximately match a user's eyebrow shape. The eyebrow recesses can be filled with eyebrow powder or other cosmetics for adding color to eyebrows. The right and left eyebrow recesses are above right and left eyelid recesses 135*m* and 135*n* (described immediately below) and below the forehead recesses 135*h* and 135*i* in one implementation.

The right and left eye palettes respectively include right and left eyelid recesses 135*m* and 135*n* and right and left under eye recesses 135*o* and 135*p*. The eye palettes may also include right and left eye images 150 where the eye images can be colored to approximately match the color of a user's eyes. For example, various implementations of the face palette include eye images with irises that are dark brown to black, light brown, amber, blue, green, gray, or other colors. The eye images can be formed on or in tray 130 via painting, color injected plastic, colored plastic, or other colorization methods. Alternatively, tray 130 can include recesses into which eye inserts may be removably inserted. The eye inserts may be molded plastic, glass, metal, or other material and may include iris images, pupil images, and sclera images or any combination of these to provide the appearance of human eyes for the eye inserts. The eye inserts may be removably held in the recesses by a variety of devices, such as glue, epoxy, mechanical fasteners, such as screws, or other devices.

The right and left eyelid recesses 135*m* and 135*n* can include one or more cosmetics of having a number of colors (including blacks, grays, various metallic colors, and other colors), color shades, or color tints. As shown in FIG. 1, each eyelid recess includes five different cosmetics, which can be a single type of cosmetic or different types of cosmetics. The five different cosmetics can have five different colors; four different colors where two of the colors are the same or similar with different shades or tints; three different colors where three of the colors are the same or similar with different shades, tints, or both; two different colors where four of the colors are the same or similar with different shades, tints, or both; or one color where each of the five colors are substantially the same or similar with different shades, tints, or both. While each eyelid recess is described and shown as including five different cosmetics, each eyelid recess can include more or fewer cosmetics.

The cosmetics in the eyelid recesses are arranged to guide a user application of the cosmetics to achieve a variety of eyelid affects, such as a cat eye styles, almond shaped eye appearance, rounded shaped eye appearance, or other style and appearances. Cosmetics for the eye recesses can be prefabricated to include these cosmetics.

The right and left eyelid recesses have a shape that approximately match the shape, for example arc shape, of human eyelids to provide guidance for a user for applying cosmetics to portions of a user's eyelids that correspond to location of cosmetics in the eyelid recesses. While the eyelid recesses are described as being arc shaped, the eyelid recesses can have other shapes such as oblong, triangular, teardrop shaped with tapers of the teardrop shapes extending toward the outer portions of the face palette and with the rounded portion of the teardrop shape located proximate to an upper portion of the nose palette or toward the center recess of the forehead palette, or other shapes. The eyelid recesses can also have a variety of heights and widths for achieving the described eyelid effects as well as other eyelid effects.

The right and left under eye recesses 135*o* and 135*p* are approximately teardrop shaped and are positioned above the cheek palettes and under eye images. The shape of the under eye recesses indicate a corresponding shape under a user's eyes where a cosmetic in the eye recesses can be applied. While the shape of the eye recesses is described and shown as teardrop shaped, these recesses can have other shapes such as oval, oblong, arced, or other shapes. The eye recesses can include highlighting cosmetics, contouring cosmetics, concealer, or other cosmetics.

The face palette includes a lip recess 135*q* in one implementation. The lip recess includes an upper and lower lip recess and includes a non-recessed area between the upper and lower lip recesses. The upper and lower lip recesses can be joined as shown in FIG. 1 or be separate recesses with a dividing partition between these recesses. In one implementation, the lip recess does not include a non-recessed area between the upper and lower lip recesses.

The lip recess can be shaped similar to a pair of human lips including a cupid's bow along a top of the lip recess and a rounded extent at the bottom of the lip recesses, where the cupid bow and rounded extend meet at corners of the lip recess (i.e., corners of the mouth).

The lip recess can include one or more cosmetics. For example, if the upper and lower lip recesses are a single recess, the lip recess may include one cosmetic or may include two cosmetics, for example, different colors or different cosmetic types, if these recesses are different recesses.

In one implementation, the cosmetic tray includes additional cosmetic recesses, such as recesses 137*a* and 137*b* positioned in the lower right and left corners of the tray. These recesses can include one or more of a variety of cosmetic types, such as concealer, foundation, setting power, luminizer (for example a luminizer powder), bronzer, blush, or shades of highlighting or contouring cosmetics that might differ from the shades of highlighting and contouring cosmetics in the face palette. Recesses 137*a* and 137*b* can have a variety of shapes to use available space on the cosmetic tray, such as triangular as shown in FIG. 1 or other shapes.

The tray can include additional recesses, such as applicator recesses 138*a* and 138*b* for holding cosmetic applicators, such as a brush 139*a* and a sponge tipped applicator 139*b*, which can have a concealer applicator, such as a concealer brush or synthetic concealer brush, at the opposite end of the applicator from the sponge tip, or for holding pencils or crayons, such as eye liner pencils or crayons, lip liner pencils or crayons, eyebrow pencils or crayons, lipsticks, or other cosmetics. In one implementation, one of these additional recesses can be shaped for holding a pair of tweezers, fingernail cutters, or other devices. The applicator recesses can have a variety of shapes that substantially match the shapes of items configured to be positioned in the recesses. For example, the applicator recesses can be substantially rectangular with variously shaped end for accommodating fan shaped brushes or other applicators or devices.

In an implementation, the cosmetic case includes a number of cosmetic pans that are removably located in the recesses. The cosmetics in the face palette are located in the cosmetic pans. The pans can be inserted and removed from the cosmetic tray by a user. The pans can be held in the recesses by a variety of devices, such as tape, glue or other adhesive, magnets positioned in or below the recesses, or other devices. Alternatively, one or more of the recesses includes ridges that extend from the sides of the recesses or from the upper edge of the recesses to engage the upper edges of the pans to mechanically hold the pans in the recesses. The pans can be put into the recesses with the upper edges of the pans pressed into the recesses slightly deforming the cosmetic tray and the recesses to position the upper edges below the ridges. The pans can be removed from the recesses by slightly deforming the tray to release the upper edges of the pans from below the ridges. The tray can be slightly deformed by twisting, placing pressure adjacent to a recesses, placing pressure on the the bottoms of the recesses, or by other deformations.

The top-inside surface of the top case portion, for example mirror 120, of the cosmetic case can hold the pans in position in the recesses when the top case portion is in a closed position with respect to the bottom case portion. Specifically, the top inside surface of the top case portion can engage the top edges of the pans to inhibit the pans from moving out from the recesses when the top case portion is closed.

The pans can be located in all of the recesses formed in the tray or can be located in fewer of the recesses. Each pan has a size and shape that approximately matches a size and shape of an associated recess in which the pan is located. For example, a teardrop shaped pan can be removably located in a teardrop shaped recess, such as the right or left cheek recesses of the face palette. The pans can be metal (for example, aluminum, tin, or other metal), plastic, or other material.

In one implementation, the pans are provided with cosmetics positioned in the pans. The cosmetics in the pans can be color matched to a user's skin tones, color matched to cosmetic affects that a user is attempting to accomplish, or both. Pans with cosmetics preloaded into the pans can be sold via a variety of stores, such as traditional brick and mortar store or internet based stores.

In one implementation, cosmetic tray 130 is formed from a number of cosmetic trays. For example, the forehead palette can be located on a unique cosmetic tray or can be located on a cosmetic tray that includes other palettes, such as the eyebrow palette. The right and left eye palettes can be located on one cosmetic tray or separately located on two different cosmetic trays. Alternatively, the eye palettes can be located on a cosmetic tray that includes other palettes, such as the forehead palette, the eyebrow palette, or other palettes. The nose palette can be located on a unique cosmetic tray or can be located on a cosmetic tray that holds other pallets, such as the cheek palettes or the eye palettes. The right and left cheek palettes can each be located on unique cosmetic trays. The lip palette can be located on a unique cosmetic tray or located on a cosmetic tray that includes other palettes, such as a chin palette.

With cosmetic tray 130 formed two or more cosmetic trays, each of the different trays forming tray 130 can be individually removed from the cosmetic case and replaced. The removed tray can be refilled with cosmetic and replaced into the cosmetic case or a different tray can replace the removed tray where the replacement tray can have the same or different cosmetics as compared to the removed tray. A seller of the trays can therefore allow a user to purchase trays individually to form a tray 130 with cosmetics that meet a user's desire to create a specific cosmetic appearance, such as to more specifically match a user's skin tones, to more specifically match a user's different skins types across their face, or for other cosmetic results.

The cosmetic case includes at least a first drawer 160 in one implementation of the invention. In another implementation, the cosmetic case includes at least a second drawer 165. In further implementations, the cosmetics case includes additional drawers, such as a third, fourth, fifth, or more drawers.

Figure 2:
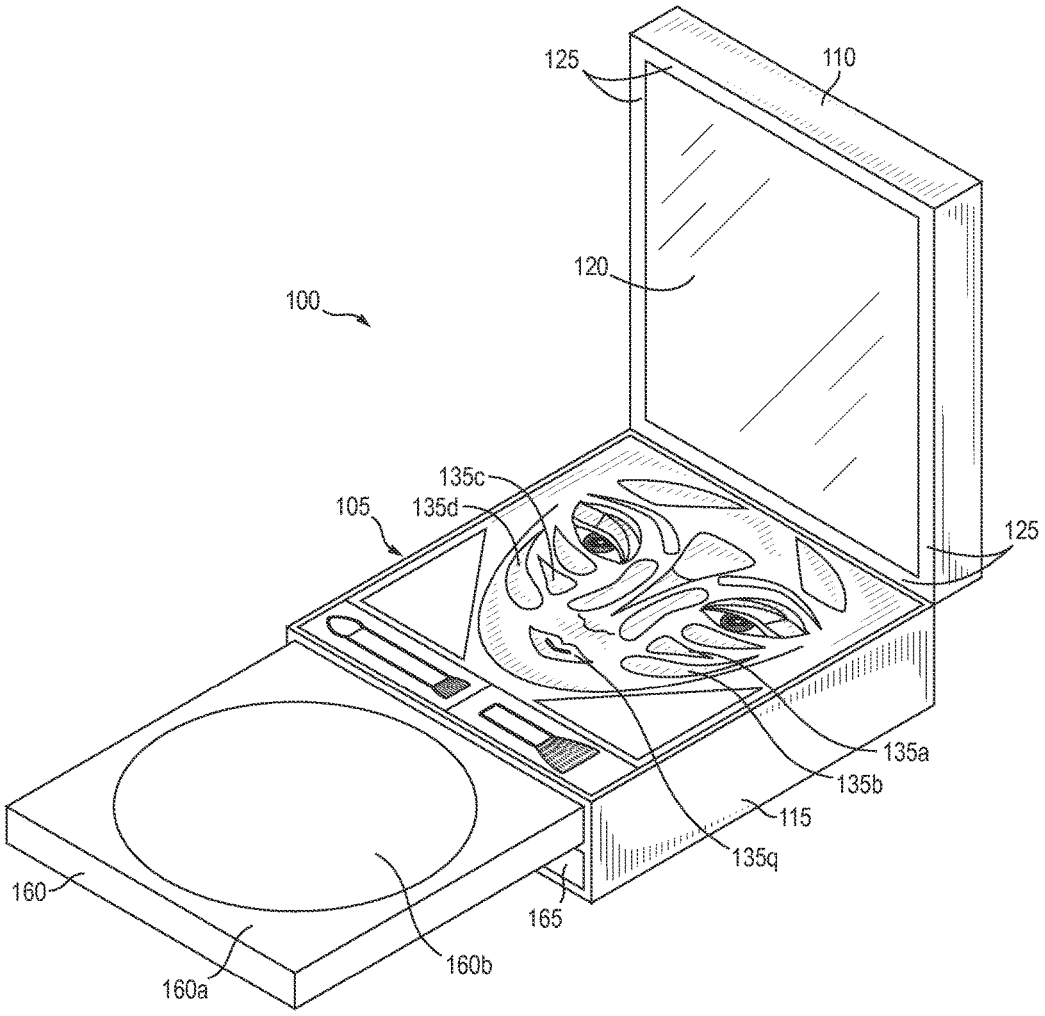
FIG. 2 is a perspective view of the cosmetic case with a first drawer extended from the cosmetic case and a second drawer positioned in the cosmetic case.
Figure 3:
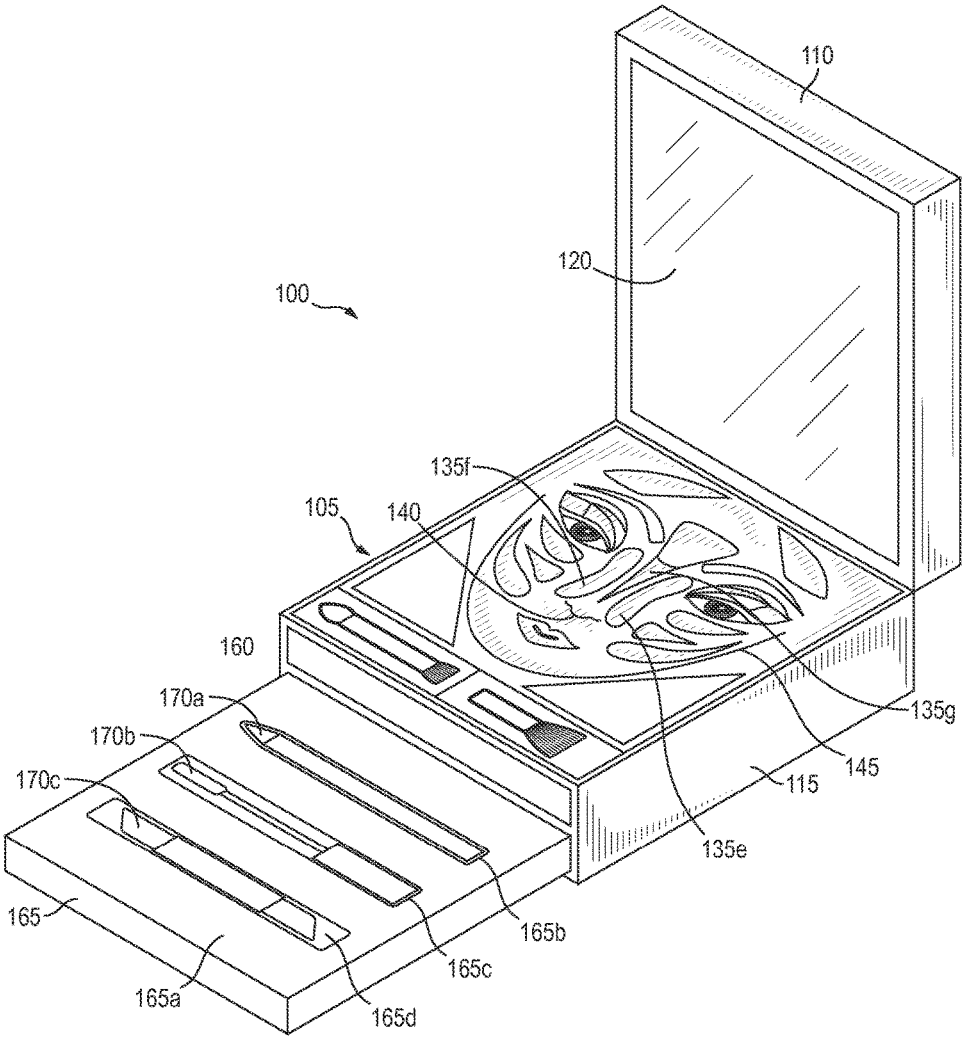
FIG. 3 is a third perspective view of the cosmetic case with the first drawer positioned in the cosmetic case and the second drawer extended from the cosmetic case.
Figure 4:
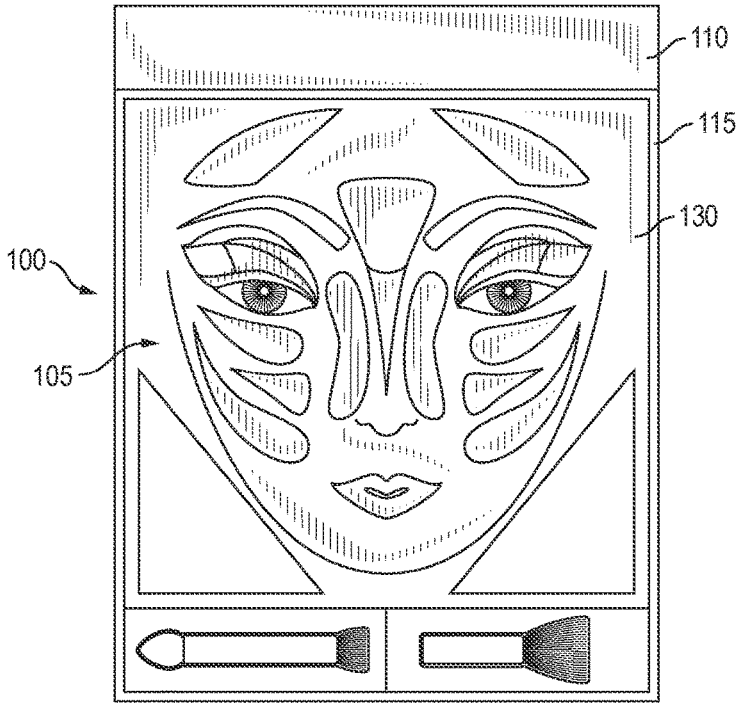
FIG. 4 is a first top view of the cosmetic case with the top in an open position.
Figure 6:
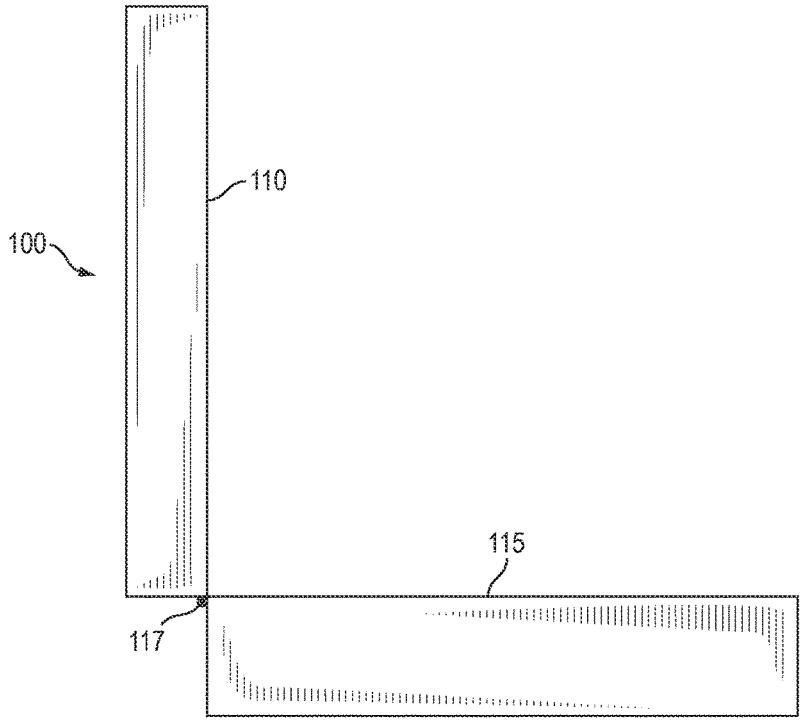
FIGS. 6 and 7 are right and left side views of the cosmetic case with the top in the open position.
Figure 7:
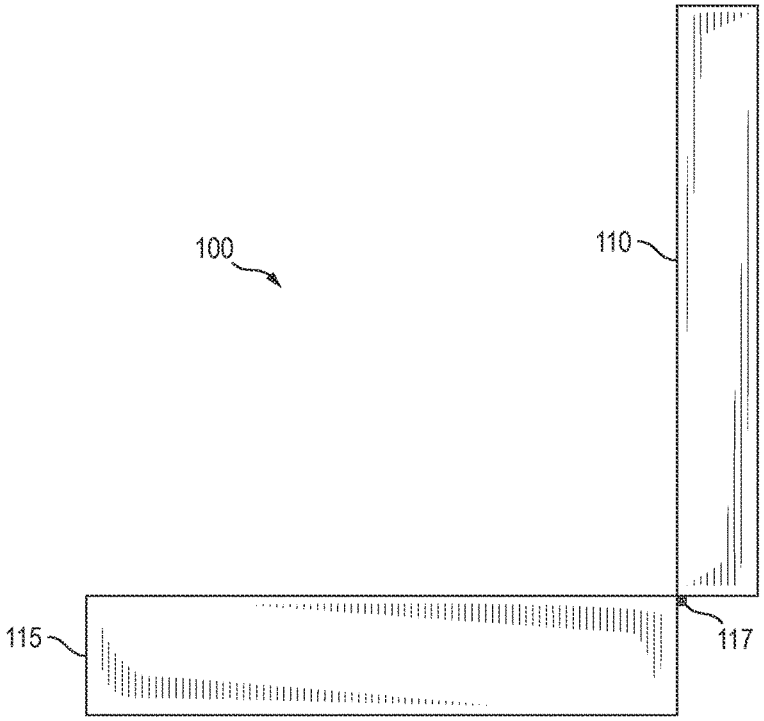
Figure 8:
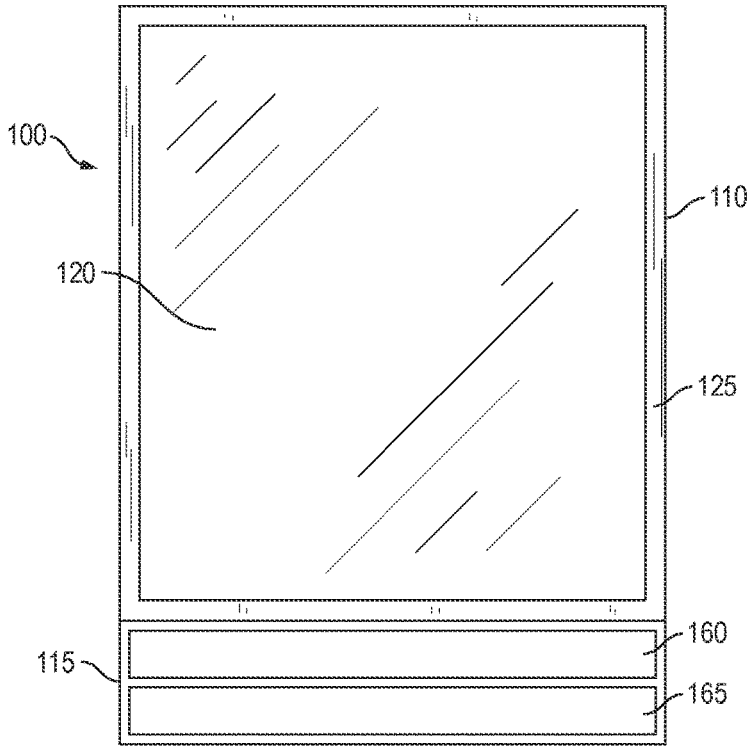
FIG. 8 is a front view of the cosmetic case with the top in the open position.

FIGS. 1, 6-7 (right and left side views with the top and bottom case portions in the open position) and 8 (front view with the top and bottom case portions in the open position) show both drawers 160 and 165 in closed positions with the drawers pushed substantially fully into the cosmetic case. FIG. 2 shows first drawer 160 in an open position with the drawer extended from the cosmetic case for use and second drawer 165 in a closed position. FIG. 3 shows first drawer 160 in a closed position and second drawer 165 in an open position.

Each of drawers 160 and 165 can include one or more features that facilitate pulling the drawers outward from the bottom portion of the cosmetic case for use. Each drawer can a detent with a ledge or a ledge with an undercut against which a user can engage a finger for pulling the drawers outward, an undercut, an extended portion extending from the front surfaces of the drawings, or other feature that facilitates pulling the drawers outward.

Each of the drawers can include one or more of a variety of cosmetics, application tools for cosmetics, or other grooming tools. In one implementation, the top drawer 160 includes a tray 160*a* with one or more recesses, such as recesses 160*b*, formed in the tray. The tray can be integrally formed with the first drawer or can be removable from the first drawer where the tray can be replaced into the first drawer or a different tray can be inserted into the first drawer.

The one or more recesses in tray 160*a* can be filled with one or more cosmetics, tools for cosmetic application, cosmetics, such as lipstick, cosmetic pencils or crayons, or other grooming tools. In one embodiment, recess 160*b* is a round recesses that can be filled with a cosmetic, such as a setting power.

In one implementation, recess 160*b* is formed in a tray or a pan that can be fitted into and lifted from tray 160*a*. Under the tray or pan adapted to be lifted from tray 160*a*, an extended recesses in tray 160*a* is formed that extends below a bottom the tray or pan when the tray or pan is positioned in recess 160*b*. The extended recess in tray 160*a* can house a cosmetic applicator, such as a pad applicator adapted to apply the power cosmetic in recess 160*b*. In some implementations, the tray or pan can be hinge coupled to tray 160*a* so that the tray or pan can be rotated upward to reveal the pad. The pad can have a variety of shapes, such as round, and can have a size that substantially matches the size of recess 160*b* or is smaller than recess 160*b*. The tray or pan can have an attached tab that facilitates lifting the tray or pan from tray 160*a*. In an alternative embodiment, the pad is positioned in recess 160*b* and a cosmetic (for example, setting powder, all over face veil, or custom face powder) is positioned in the extended recess that is below recess 160*b*.

In an alternative implementation, the recesses in tray 160*a* from a second face palette, such as the face palette in tray 130. The face palette in tray 160*a* may be similar to the face palette in tray 130 or can include different recesses, different cosmetics, or both. For example, the face palette in tray 130 may include cosmetics for a daytime appearance, such as for bright daylight, for bright indoor light in a work environment or other relatively brightly lighted environments. In contrast, the cosmetics in the face palette in tray 160*a* may include cosmetics for an evening or nighttime appearance where lighting may be relatively dimmed compared to daytime lighting. For example, the nighttime cosmetics in the face palette in tray 160*a* may be more intensely hued for a more sensual appearance as compared to cosmetics for a daytime appearance, which may be relatively more neutral for professional appearance in an office environment or other environment. [99] Drawer 165 can include a tray 165*a* that can include one or more recesses for cosmetics, cosmetic application tools, other grooming tools, or for one or more of these in any combination. In the implementation shown in FIG. 3, tray 165*a* includes three recesses 165*b*, 165*c*, and 165*d*. The recesses are elongated and are approximately rectangular in shape for holding various grooming tools or cosmetics 170*a*, 170*b*, and 170*c*. In one implementation, the recesses in tray 165*a* form an additional face palette, such as a second or third face palette, which can be similar to or different from the face palettes described above. The color palette of the cosmetics in a third face palette can differ from the other face palette, such as for a bright outdoor sun environment or other environment.

The cosmetic case and cosmetic tray located in the bottom portion of the cosmetic tray can have a variety of sizes and shapes for professional use in a salon, on a movie set, in a photo studio, or for home use, office use, school use, travel use, and other uses. For example, the cosmetic case and cosmetic tray can be square, rectangular, round, oblong, elliptical, capricious, or other shapes. For example, the cosmetic case can be 6 inches by 6 inches, 6.5 inches by 6.5 inches, 7 inches by 7 inches, or greater for a square case for professional use or for home use. The cosmetic case can be smaller for carrying for portable use away from home, such as 5 inches by 5 inches, 4.5 inches by 4.5 inches, 4 inches by 4 inches, 3.5 inches by 3.5 inches, 2 inches by 2 inches, 2.5 inches by 2.5 inches, or other sizes. A rectangular implementation of the cosmetic case can have any combination of these lengths for the length and the width of the cosmetic case. Similarly, a round cosmetic case, such as a circular cosmetic case can have any of these lengths for a radius or a diameter of the cosmetic case. Other cosmetic cases that are oblong, elliptical, capricious, or other shapes can have any of these lengths for lengths, widths, or other dimensions of the cosmetic case.

Various embodiments of the cosmetic case can have a variety of heights. For example, a cosmetic case for professional use or for home use can be 2 inches, 2.5 inches, 3 inches or greater with none, one, two, three, four, or more drawers. The cosmetic case can have other heights for portable use away from home, such as 1.5 inches, 1 inch, or less with none, one, two, three, four, or more drawers.

The recesses in the face palette and for the cosmetic application tools can have a variety of sizes. For example, the recesses can be about a ¼ inch to several inches in length, width, or both. The recesses can also have a variety of depths, such as a tenth of an inch to ½ of an inch or more. Cosmetic pans included in some of the implementations can have similar sizes.

The present invention provides a number of features and benefits. For example, the face palette includes cosmetics located at positions on the face palette that correspond to locations on a user's face, and thereby provides guidance for a user for where the cosmetics are to be applied to the user's face. Namely, the cosmetics in the specific locations in the face palette are to be applied to corresponding locations on a user's face. For example, cosmetics in the forehead palette are to applied to corresponding locations on a user's forehead, cosmetics in the eye palette are to be applied to corresponding locations around a user's eyes, cosmetics in the cheek palettes are to be applied to corresponding locations on a user cheekbone ridges and cheeks, cosmetics in the nose palette are to applied to corresponding location on a user nose, and cosmetics in the lip palette are to be applied to corresponding portions of the user's lips.

The face palette, therefore, provides a visible application guide for cosmetic application to a user's face to achieve various application effects of the cosmetics, such as highlighting, contouring, achieving various eyelid patterns, eyebrow effects, and other effects.

Not only do the locations of the recesses and cosmetics in the face palette provide a visible application guide for cosmetic application, the shapes and sizes of the recesses and the cosmetics in the recesses provide a guide for the extent of the application of the cosmetics on a user's face for achieving various cosmetic effects.

Further, the configuration and the shapes of the recesses, the cosmetics in the face palette, and the various lines (nose, jaw, or others) provide a substantially human facial image that is esthetically pleasing and provides additional perspective and guidance for where cosmetics in the cosmetic recesses are to be applied to a user's face. This description of the invention has been presented for the purposes of illustration and description. It is not intended to be exhaustive or to limit the invention to the precise form described, and many modifications and variations are possible in light of the teaching above. For example, elements of the various implementations described can be interchanged in any combination of elements of one or more elements, combined in any combination of one or more elements, or removed in any combination of one or more elements. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claim is:

1. A cosmetic tray comprising:

a first plurality of cosmetic recesses, forming a forehead palette, comprising right and left forehead recesses, right and left eyebrow recesses positioned respectively below the right and left forehead recesses, and a center recess positioned between the right and left eyebrow recesses;

a right eyelid recess, positioned below the right eyebrow recess;

a left eyelid recess, positioned laterally adjacent to the right eyelid recess and below the left eyebrow recess;

a second plurality of cosmetic recesses, forming a nose palette, comprising a right side nose recess, a left side nose recess, and a nose bridge recess positioned between the right and left side nose recesses;

a first surface portion positioned between the right side nose recess and the nose bridge recess that is not recessed;

a second surface portion positioned between left side nose recess and the nose bridge recess that is not recessed, wherein the right side nose recess is a separate recess from the left side nose recess and the nose bridge recess and is separated from the left side nose recess and the nose bridge recess by the first surface portion that is not recessed, and the left side nose recess is a separate recess from the nose bridge recess and is separated from the nose bridge recess by the second surface portion that is not recessed;

a third plurality of cosmetic recesses, forming a right cheek palette, comprising a first cheek recess and a second cheek recess, wherein the first cheek recess is positioned above the second cheek recess and below the right eyelid recess;

a fourth plurality of cosmetic recesses, forming a left cheek palette, comprising a third cheek recess and a fourth cheek recess, wherein the third cheek recess is positioned above the fourth cheek recess and below the left eyelid recess; and a lip recess, forming a lip palette, positioned below the nose palette.

2. The cosmetic tray of claim 1 wherein the nose bridge recess has an elongated shape.

3. The cosmetic tray of claim 2 wherein the elongated shape is approximately triangular.

4. The cosmetic tray of claim 1 wherein the right nose recess has a first arc shape, the left nose recess has a second arc shape, and the first and second arc shapes are laterally opposite arc shapes.

5. The cosmetic tray of claim 4 wherein the first and second arc shapes have openings that face away from each other.

6. The cosmetic tray of claim 1 wherein the lip recess comprises an upper lip portion having an upper lip shape and a lower lip portion having a lower lip shape.

7. The cosmetic tray of claim 1 wherein the lip recess comprises an upper lip recess and a lower lip recess.

8. The cosmetic tray of claim 7 wherein the lip recess comprises a partition located between and separating the upper lip recess from the lower lip recess.

9. The cosmetic tray of claim 1 wherein the right eyelid recess has a first relatively arc shape, the second eyelid recess has a second relatively arc shape, and the first and second relatively arc shapes are laterally opposite shapes.

10. The cosmetic tray of claim 1 comprising a first line, positioned below the nose palette and above the lip palette, having right and left nostril lines and a septum line positioned between the right and left nostril lines.

11. The cosmetic tray of claim 10 wherein the right and left nostril lines are not recesses for containing a cosmetic.

12. The cosmetic tray of claim 1 wherein the first, second, third, and fourth plurality of recesses, the right and left eyelid recesses, and the lip recess form a facial image for a face palette of cosmetics.

13. The cosmetic tray of claim 12 comprising a cosmetic recess not forming a portion of the face palette.

14. The cosmetic tray of claim 12 comprising a line, representing a jaw line for the face palette.

15. The cosmetic tray of claim 1 comprising a plurality of cosmetics located in the first, second, third, and fourth plurality of recesses, the right and left eyelid recesses, and the lip recess.

16. The cosmetic tray of claim 1 comprising an applicator recesses adapted for holding a cosmetic applicator.

17. The cosmetic tray of claim 1 wherein the first cheek recess has a first teardrop shape that has a first tapering portion, the second cheek recess has a second teardrop shape that has a second tapering portion, the third cheek recess has a third teardrop shape that has a third tapering portion, the fourth cheek recess has a fourth teardrop shape that has a fourth tapering portion, the first and second tapering portions extends towards a first side of the cosmetic tray, the third and fourth tapering portions extends towards a second side of the cosmetic tray, and the first and second sides of the cosmetic tray are opposite sides of the cosmetic tray.

18. The cosmetic tray of claim 17 wherein the first tapering portion has a first length, the second tapering portion has a second length, the third tapering portion has a third length, the fourth tapering portion has a fourth length, the second length is longer than the first length, and the fourth length is longer than the third length.

19. The cosmetic tray of claim 18 wherein the first cheek recess is positioned at a first cheekbone location, the second cheek recess is positioned at a first cheek location, the third cheek recess as positioned at a second cheekbone location, and the fourth cheek recess is positioned at a second cheek location.

20. The cosmetic tray of claim 1 wherein the first and second check recesses, the third and fourth cheek recesses, and the right nose recess, left nose recess, and nose bridge recess form tutorials for cosmetic application for cosmetic highlighting or contouring of the right cheek, the left cheek, and the nose.

21. The cosmetic tray of claim 1 wherein the second plurality of cosmetic recesses, forming the nose palette, comprises a septum recess positioned between the nose bridge recess and the lip recess.

22. The cosmetic tray of claim 1 wherein the third plurality of cosmetic recesses, forming the right cheek palette, comprises a fifth cheek recess, the second cheek recess is between the first and fifth cheek recesses, and wherein the fourth plurality of cosmetic recesses, forming the left cheek palette, comprises a sixth cheek recess, wherein the fourth cheek recess is between the third and sixth cheek recesses.

23. The cosmetic tray of claim 22 wherein the fifth cheek recess is a right jaw recess and the sixth cheek recess is a left jaw recess.

24. A cosmetic case comprising:

a top case;

a bottom case coupled to the top case; and a first cosmetic tray positioned in the bottom case, wherein the first cosmetic tray comprises:

a first plurality of recesses, forming a forehead palette, comprising a right eyebrow recess, a left eyebrow recesses, and a center recess positioned between the right and left eyebrow recesses;

a right eyelid recess, positioned below the right eyebrow recess;

a left eyelid recess, positioned laterally adjacent to the right eyelid recess and below the left eyebrow recess;

a second plurality of cosmetic recesses, forming a nose palette, comprising a right side nose recess, a left side nose recess, and a nose bridge recess positioned between the right and left side nose recesses, wherein the right side nose recess, the left side nose recess, and the nose bridge recess are separated by non-recessed portions of the first cosmetic tray;

a third plurality of cosmetic recesses, forming a right cheek palette, comprising a first cheek recess and a second cheek recess, wherein the first cheek recess is positioned above the second cheek recess and below the right eyelid recess;

a fourth plurality of cosmetic recesses, forming a left cheek palette, comprising a third cheek recess and a fourth cheek recess, wherein the third cheek recess is positioned above the fourth cheek recess and below the left eyelid recess; and a lip recess, forming a lip palette, positioned below the nose palette, wherein the first, second, third, and fourth plurality of recesses and the lip recess form a first face palette of recesses; and a first plurality of cosmetics that form a first face palette of cosmetics when positioned in the first, second, third, and fourth plurality of recesses and the lip recess.

25. The cosmetic case of claim 24 wherein the first cosmetic tray comprises a cosmetic recess not forming a portion of the first face palette of recesses.

26. The cosmetic case of claim 24 comprising:

a first drawer extendabley inserted in a slot of the bottom case; and a second cosmetic tray positioned in the first drawer, wherein the second cosmetic tray comprises a fifth plurality of recesses forming a second face palette of recesses and adapted to contain a second plurality of cosmetics that form a second face palette of cosmetics when positioned in the fifth plurality of recesses.

27. The cosmetic case of claim 26 comprising:

a second drawer extendabley inserted in a second drawer slot of the bottom case; and a third cosmetic tray positioned in the second drawer, wherein the third cosmetic tray comprises a sixth plurality of recesses adapted for containing a plurality of cosmetic applicators.

28. The cosmetic case of claim 24 comprising:

a first drawer extendabley inserted in a first drawer slot of the bottom case; and a second cosmetic tray positioned in the first drawer, wherein the second cosmetic tray comprises at least one recess adapted for containing at least one cosmetic.

29. The cosmetic case of claim 28 comprising:

a second drawer extendabley inserted in a second drawer slot of the bottom case; and a fifth plurality of recesses forming a second face palette of recesses and adapted to contain a second plurality of cosmetics that form a second face palette of cosmetics when positioned in the fifth plurality of recesses.

30. The cosmetic case of claim 24 wherein the first plurality of cosmetic recesses comprises a forehead palette, comprising a right forehead recess and a left forehead recesses, the right and left eyebrow recesses are positioned respectively below the right and left forehead recesses.

31. A method comprising:

providing a cosmetic tray;

forming a first plurality of cosmetic recesses in the cosmetic tray for a forehead palette, wherein the first plurality of cosmetic recesses comprises right and left forehead recesses, right and left eyebrow recesses positioned respectively below the right and left forehead recesses, and a center recess positioned between the right and left eyebrow recesses;

forming a right eyelid recess in the cosmetic tray, wherein the right eyelid recess is positioned below the right eyebrow recess;

forming a left eyelid recess in the cosmetic tray, wherein the left eyelid recess is positioned laterally adjacent to the right eyelid recess and below the left eyebrow recess;

forming a second plurality of cosmetic recesses in the cosmetic tray for a nose palette, wherein the second plurality of cosmetic recesses comprises a right side nose recess, a left side nose recess, and a nose bridge recess positioned between the right and left side nose recesses forming a first non-recessed surface portion separating the right side nose recess and the nose bridge recess;

forming a second non-recessed surface portion separating the left side nose recess and the nose bridge recess;

forming a third plurality of cosmetic recesses in the cosmetic tray for a right cheek palette, wherein the third plurality of cosmetic recesses comprises a first cheek recess and a second cheek recess, and the first cheek recess is positioned above the second cheek recess and below the right eyelid recess;

forming a fourth plurality of cosmetic recesses in the cosmetic tray for a left cheek palette, wherein the fourth plurality of cosmetic recesses comprises a third cheek recess and a fourth cheek recess, and the third cheek recess is positioned above the fourth cheek recess and below the left eyelid recess; and forming a lip recess for a lip palette, wherein the lip recesses is positioned below the nose palette.

32. The method of claim 31 wherein each of the recesses has a shape that indicates an extent for applying a cosmetic in the recess to a user's face.

33. The method of claim 31 comprising:

forming a first line in the cosmetic tray below the nose palette and above the lip palette, wherein the first line has right and left nostril lines and a septum line positioned between the right and left nostril lines; and forming a second line in the cosmetic tray representing a jaw line for a face palette formed by the recesses.

34. The method of claim 31 wherein the first, second, third, and fourth plurality of recesses, the right and left eyelid recesses, and the lip recess form a facial image for a face palette of cosmetics.

35. The method of claim 34 comprising forming a cosmetic recess in the cosmetic tray, wherein the cosmetic recess does not form a portion of the face palette.

36. The method of claim 34 comprising inserting a plurality of cosmetics into each of the recesses.

* * * * *